United States Patent [19]

Creech

[11] 4,271,638

[45] Jun. 9, 1981

[54] PORTABLE SURFACE GRINDING MACHINE

[76] Inventor: William C. Creech, 1401 Kraft Rd., Jacksonville, Fla. 32218

[21] Appl. No.: 40,599

[22] Filed: May 18, 1979

[51] Int. Cl.[3] ..... B24B 41/02

[52] U.S. Cl. ..... 51/241 S; 409/204

[58] Field of Search ..... 51/98 R, 166 MH, 170 PT, 51/176, 241 S; 409/178, 184, 204; 308/3 R, 3 A, 3.8, 6 R

[56] References Cited

U.S. PATENT DOCUMENTS

| | | | |
|---|---|---|---|
| 870,082 | 11/1907 | Chadwick | 51/241 S |
| 1,373,193 | 3/1921 | Lumsden | 409/204 X |
| 2,111,052 | 3/1938 | Muzzo | 51/241 S |
| 2,190,213 | 2/1940 | Meyer | 308/3 A |
| 2,392,035 | 1/1946 | Fett | 409/204 X |
| 2,635,930 | 4/1953 | Daugherty | 308/3 A |
| 2,948,997 | 8/1960 | Seirig | 51/166 MH |
| 3,069,819 | 12/1962 | Gilmore | 409/204 X |
| 3,298,048 | 1/1967 | Dziki | 51/98 R |
| 3,815,293 | 6/1974 | Karbowski | 308/3 A |

*Primary Examiner*—Gary L. Smith

[57] ABSTRACT

A portable surface grinder having a carriage mounted on wheels which roll in two parallel tracks of a frame resting on the surface to be ground, the carriage being slideable from side to side on the shafts carrying the wheels, a third shaft which is rotatable within the carriage and in which is journaled a fourth shaft which is mounted eccentrically with respect to the third shaft and on which is mounted the grinding wheel, the third shaft being rotatably controlled so as to raise or lower the grinding surface of the grinding wheel.

7 Claims, 7 Drawing Figures

PORTABLE SURFACE GRINDING MACHINE

BRIEF SUMMARY OF THE INVENTION

There are many occasions where a metal surface must be ground smooth for proper operation and where it would be a serious economic loss to dismantle the machine sufficiently such that the part to be ground could be placed upon a large immovable grinding machine. In large internal combustion engines there is normally a removable head which is bolted to the base of the engine so that by removing the head access may be had to the internal moving parts for repair. In order that there be a tight fit to contain the pressures inside such an engine the surfaces of the head and of the base of the engine are normally ground to a reasonably precise flat condition. So as to form a pressure tight joint when properly assembled with a gasket. In use these surfaces sometimes need repair because of cracks which develop in the operation of the engine and which must be welded or brazed in order to return the engine to its proper operating condition. After welding any such surface must be ground smooth to its original flat condition in order that a proper pressure tight joint may be obtained. It is an object of the present invention to provide a portable grinding machine which can be employed in many situations to grind a flat surface on large pieces of equipment without having to dismantle that equipment. The operation of the machine of this invention is applicable for grinding turbine casings, pump housings, motor bases, machine pedestals, and other such pieces of industrial equipment.

The novel features believed to be characteristic of this invention are set forth with particularity in the appended claims. The invention itself, however, both as to its organization and method of operation together with further objects and advantages thereof, may best be understood by reference to the attached drawings and to the following description.

BRIEF DESCRIPTION OF THE DRAWINGS

In the attached drawings there are several views of the elements and features of this invention.

DETAILED DESCRIPTION OF THE INVENTION

Figure 1:
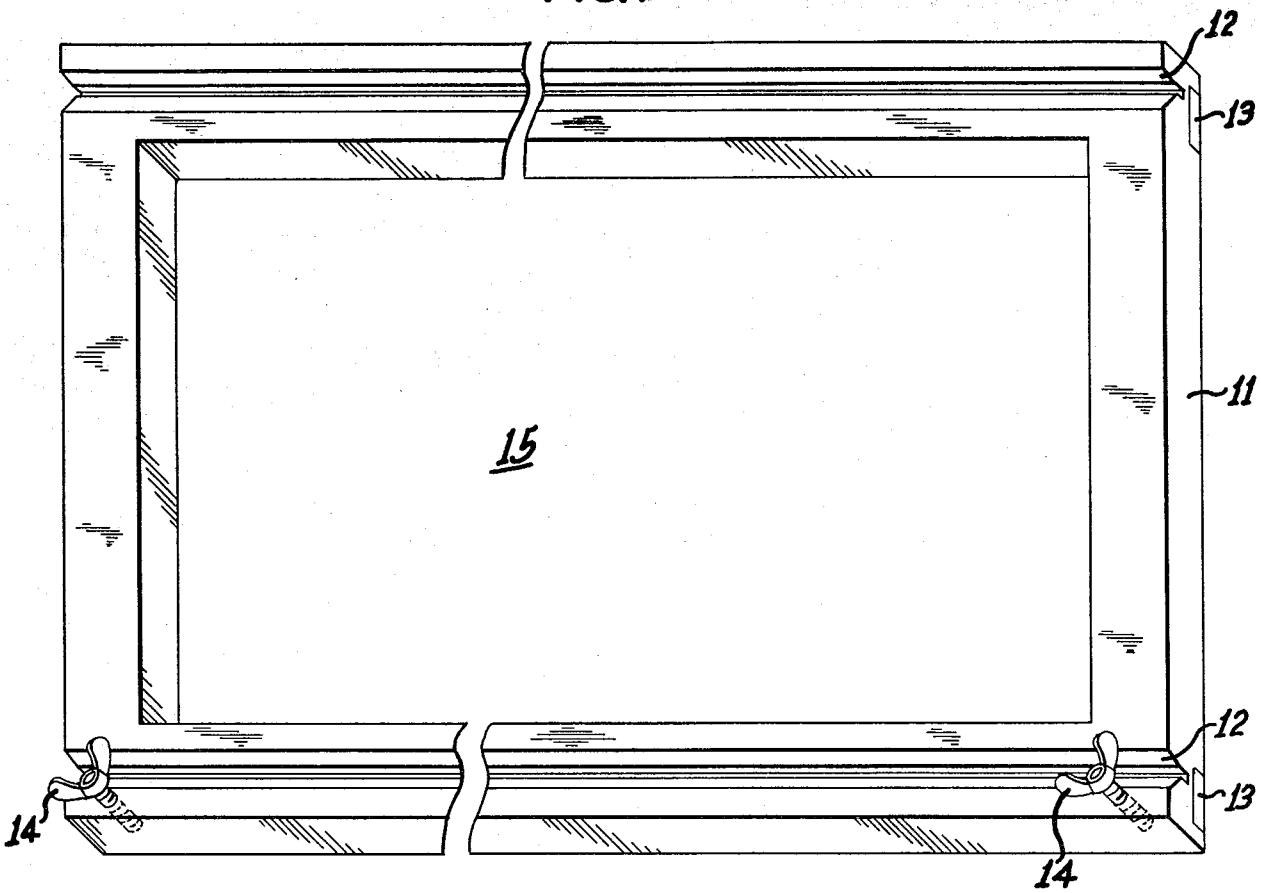
FIG. 1 is a perspective view of the supporting frame on which the grinding machine of this invention operates.

In FIG. 1 there is shown the structure which forms the base of the grinding machine of this invention. The structure comprises a generally rectangular supporting frame 11 onto which are machined two tracks 12 that are parallel to each other and are placed on the long sides of the rectangle. On the underneath side of frame 11 magnets are inset and held by flat head screws (not shown) and serve to hold frame 11 onto the surface which is to be ground if that surface is subject to magnetic attraction. Although it is preferred that each of magnets 13 extend the full length of frame 11 in order to provide the maximum in stability and attachment, such an arrangement is not critical, it being necessary only that there be a sufficient number and size to hold the machine firmly in place during operation. Furthermore, for light grinding magnets are not needed at all. Thumb screws 14 are employed to break the magnetic attachment when it is desired to remove frame 11 from the underlying surface. Two thumb screws are shown in this drawing although it is to be understood that more than two may be employed in certain embodiments of this invention. Frame 11 is made with a large open space 15 in which the grinding mechanism of this invention is positioned to form its function. Frame 11 is illustrated in this drawing as having a flat planar lower surface for resting on a flat planar surface to be ground. It is to be understood, however, that minor modifications may be made in this element of the invention to make the grinding mechanism applicable to surfaces which are not planar. For example, large cylindrical surfaces, such as a large boiler, can be ground by the mechanism of this invention if frame 11 is fitted with adjustable legs or is made in such a way that the short sides of the rectangle have undercut lower surfaces so that only the two long sides of the rectangle rest on the surface to be ground.

Figure 2:
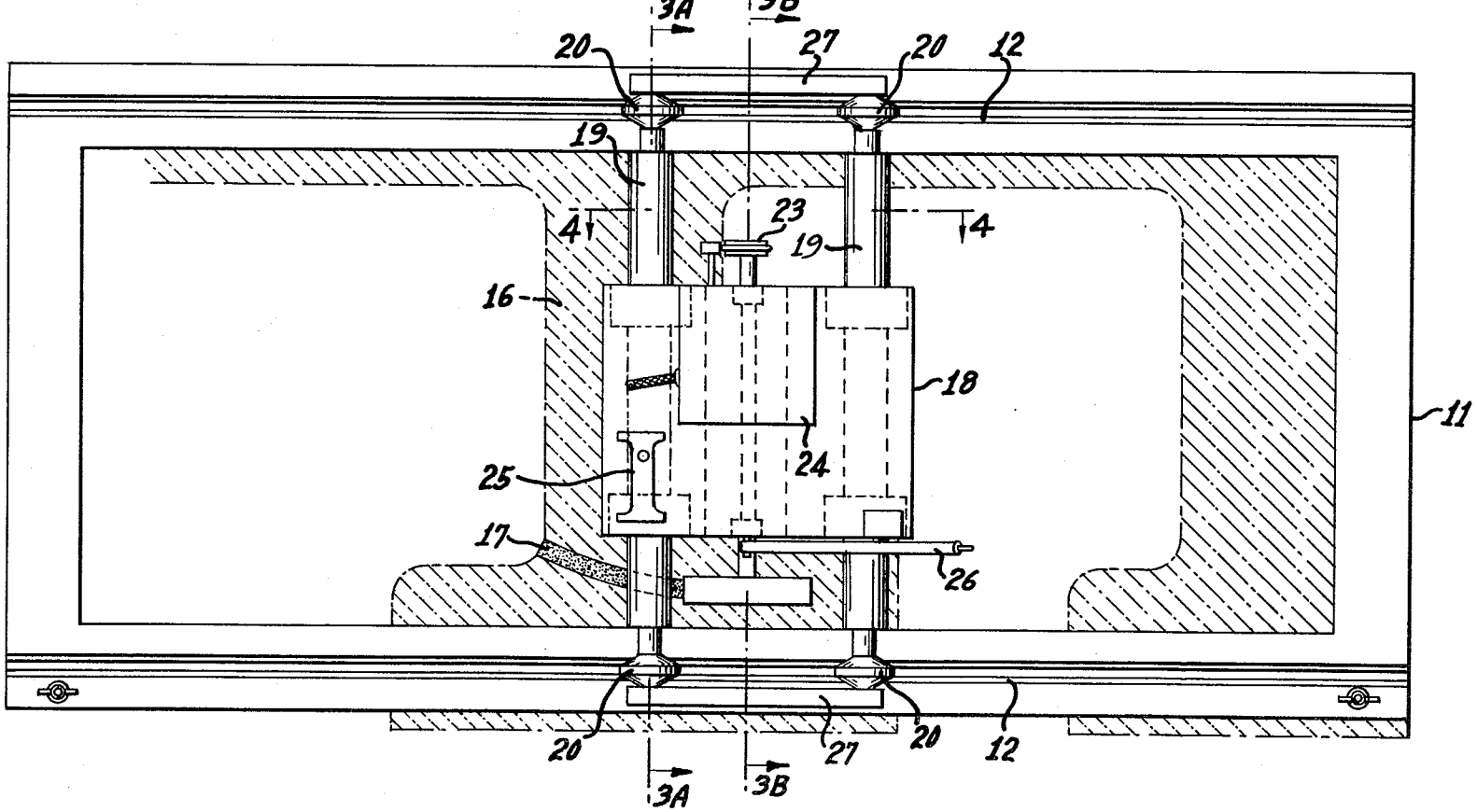
FIG. 2 is a plan view of the machine of this invention indicating how it might be employed to grind a welded area on a large piece of equipment.
Figure 3:
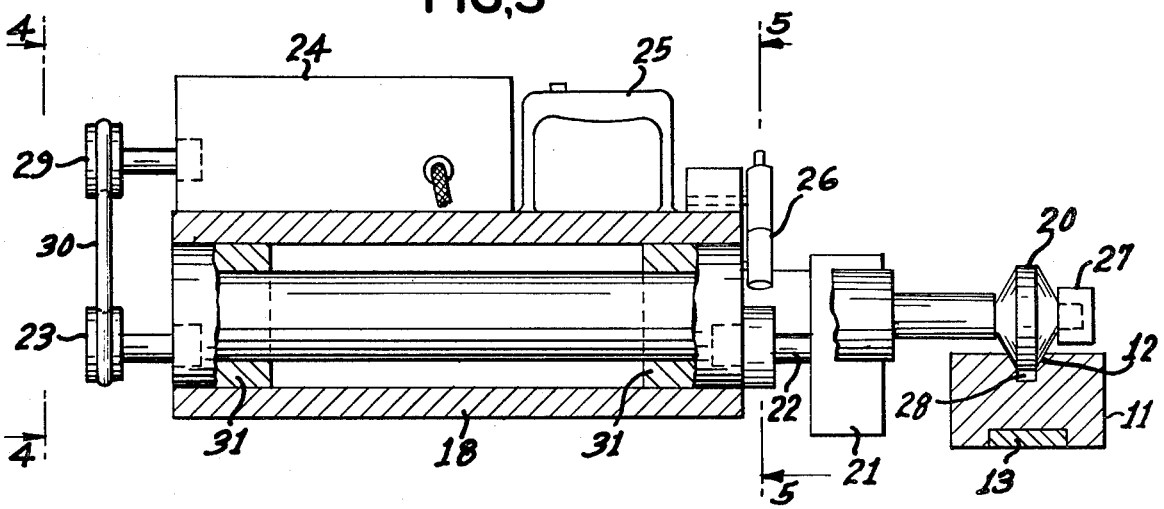
FIG. 3 is a partial transverse sectional view in elevation of this machine.
Figure 4:
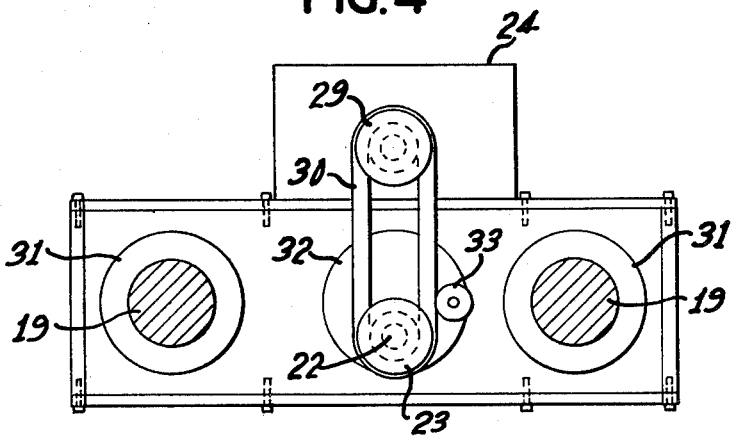
FIG. 4 is a sectional view taken along line 4—4 of FIG. 3

In FIG. 2 there is shown a plan view of the apparatus of this invention resting on a surface to be ground. Machine part 16 is shown as having a welded area 17 which must be ground down so that no part of the welded area projects above or below the flat surface represented by the shaded area of part 16. Frame 11 rests on machine part 16. The grinding mechanism is supported by slideable carriage 18 mounted on shafts 19 which terminate in wheels 20 that are fashioned to roll in parallel tracks 12. Carriage 18 also supports grinding wheel 21 mounted on shaft 22 which is driven through pulley 23 by electric motor 24. Handle 25 is mounted on carriage 18 to permit a manual operation of moving carriage 18 from side to side on shafts 19 and of rolling carriage 18 forward and back on wheels 20. Grinding wheel 21 is raised or lowered with respect to the surface to be ground by an eccentrically mounted shaft 22 and the position of that shaft is maintained by controller 26 which will be described in more detail with respect to FIG. 5. Bearings in wheels 20 are protected from the abrasive action of dust produced by the grinding operation by covers 27. Wherever possible in the apparatus of this invention sealed bearings are used to prevent the abrasive dust caused by the grinding operation from damaging the bearings and moving parts of this invention.

Wheels 20 are preferably made with V-shaped surfaces to run in a corresponding track 12 in supporting frame 11. The exact angle of the wheels and track 12 is not critical, an inclusive angle of about 60° degrees being preferable and being shown in this drawing. At the bottom of each track 12 there is an undercut 28 which serves to collect any abrasive dust which may fall into track 12. Motor 24 which is supported on carriage 18 provides the power for operating grinding wheel 21 by means of motor pulley 29 and driving belt 30, which in turn, drives pulley 23 that is directly connected to grinding wheel 21. Belt 30 may be V-belt, an O-ring, or any other convenient driving belt with pulleys 23 and 29 corresponding to the type of belt used. An operable alternative for this power train is a chain and sprocket drive. An O-ring with corresponding pulleys is preferred. Each of shafts 19 is mounted in a pair of busings 31 which permit carriage 18 to slide lengthwise on shaft 19 and thereby permit some movement of grinding wheel 21 from side to side between the limits of the supporting frame 11.

Figure 3A:
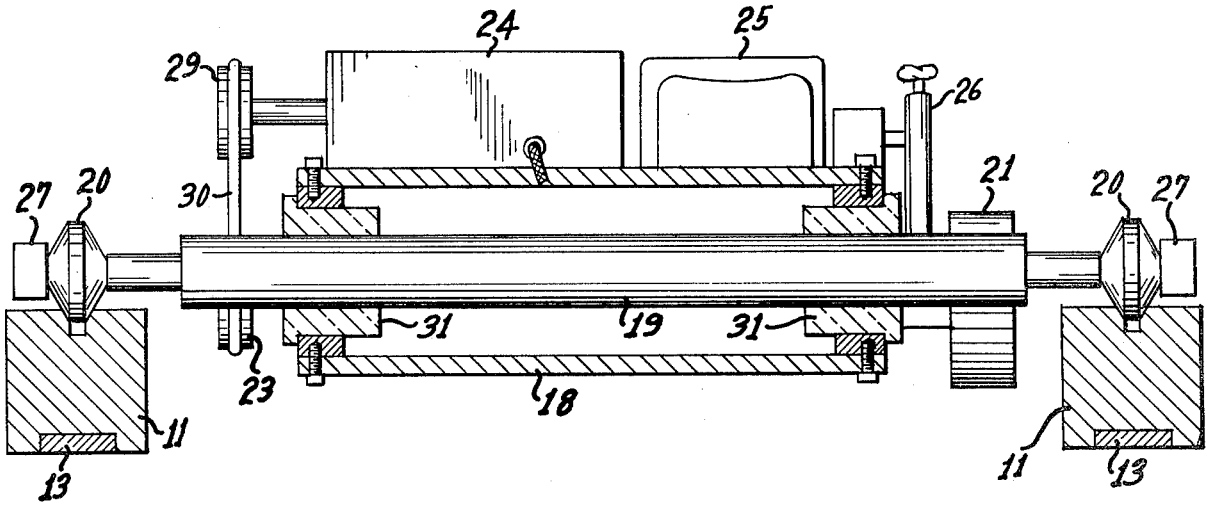
FIG. 3A is a sectional view taken along line 3A—3A in FIG. 2.
Figure 3B:
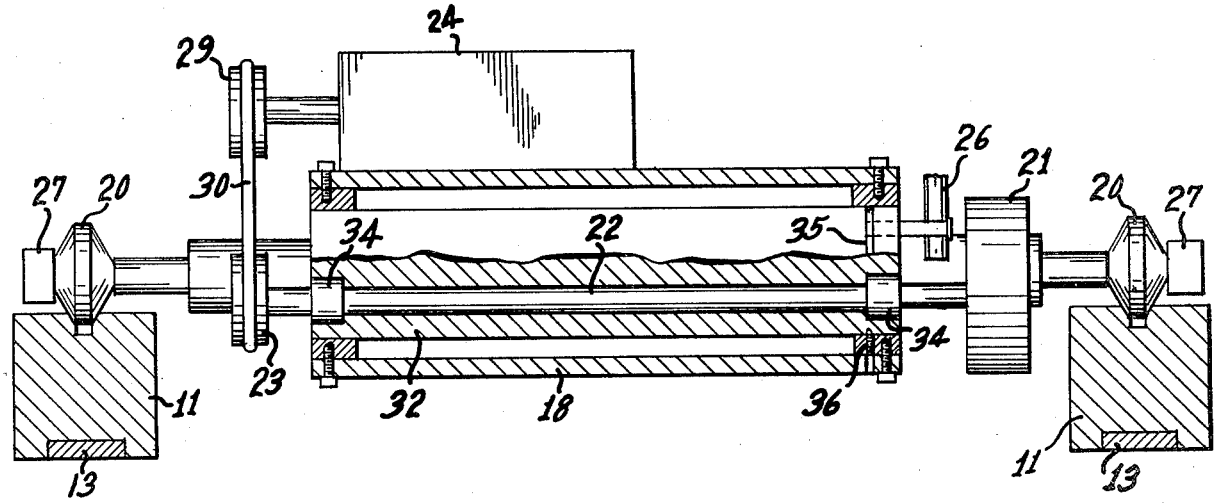
FIG. 3B is a sectional view taken along line 3B—3B in FIG. 2.

With reference to FIGS. 3A, 3B, 4 and 5 there may be seen the arrangement which drives grinding wheel 21 and permits it to be adjusted to the surface to be ground. In FIG. 3A it can be seen that carriage 18 is able to slide to the left or to the right because shafts 19 are mounted in busings 31 and that this motion permits a certain lateral adjustment for grinding wheel 21. In FIG. 3B there is illustrated the arrangement of eccentric shaft 32 which is free to rotate in carriage 18 but without a lateral movement as described with respect to shafts 19 and busings 31 in FIG. 3A. Lateral movement of shaft 32 is prevented by any suitable means, the one illustrated here being a combination of groove 35 in the surface of shaft 32 cooperating with roller tipped set screw 36 mounted in carriage 18. Mounted eccentrically in shaft 32 is drive shaft 22 for grinding wheel 21 with appropriate bearings 34 to permit shaft 22 to rotate freely without regard to the positioning and motion of shaft 32. Shaft 22 is driven through pulley 23, belt 30, and pulley 29 by electric motor 24. Shaft 32 is rotated by means of eccentric controller 26, which in turn, causes grinding wheel 21 to be raised or lowered with respect to the surface to be ground. With the particular reference to FIG. 4 it will be seen that as shaft 32 is rotated to raise or lower shaft 22 the distance between pulleys 23 and 29 may change and accordingly, in order to maintain tension on belt 30, idler pulley 33 is needed.

Figure 5:
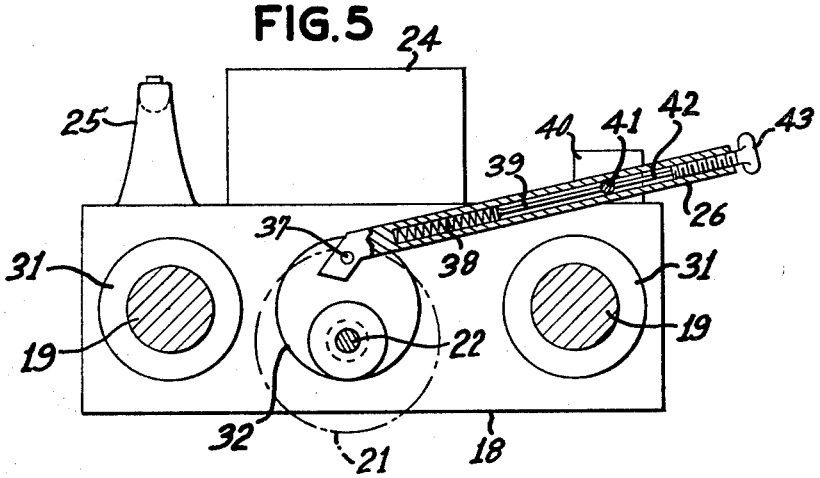
FIG. 5 is a sectional view taken along line 5—5 of FIG. 3

In FIG. 5 the operation of controller 26 can be illustrated. Controller 26 is mounted on pivot pin 41 which in turn is supported by mounting 40. Pivot pin 41 is stationary and controller 26 is free to rotate about pin 41 and to slide lengthwise by reason of a slot (not shown) fitting around the shank of pin 41 and extending for a suitable distance above and below the illustrated location of pin 41. The foot of controller 26 is mounted pivotally on eccentric pin 37 which is fixed to shaft 32. Controller 26 is drilled and tapped to receive spring 38 in the lower portion and thumb screw 43 in the upper portion. Spring follower 39 transmits the compression forces of spring 38 to pin 41. Screw follower 42 bears against pin 41 causing the body of controller 26 to move as thumb screw 43 is loosened or tightened. In the view shown in FIG. 5 the eccentric arrangement is adjusted to cause grinding wheel 21 to be in its lowermost position and with eccentric pin 37 being in a vertical position directly above the axis of drive shaft 22. It will be seen that this corresponds to the position of thumb screw 43 being turned to its most inward position in controller 26. If thumb screw 43 is twisted in the opposite direction (unloosened) the body of controller 26 will be caused to move the left and that movement will be transmitted through the slot cooperating with pivot pin 41 and the force of spring 38 to cause eccentric pin 37 to move to the left which in turn causes shaft 32 to rotate counterclockwise. This counterclockwise rotation causes a corresponding movement in the counterclockwise direction with respect to shaft 22 which raises the face of grinding wheel 21 to a higher elevation. In this fashion it may be seen that by a suitably twisting thumb screw 43 the elevation of the face of grinding wheel 21 can be adjusted. By combining the elevation of the face of grinding wheel 21 in the fashion just described with the side-to-side motion of carriage 18 on shafts 19 and bushings 31, and the forward and back motion imparted by manually pushing or pulling handle 25 to move carriage 18 through the rolling of wheels 20, the face of grinding wheel 21 can be adjusted to a wide latitude of positions.

While the invention has been described with respect to certain specific embodiments it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A portable surface grinder comprising a frame with a pair of spaced parallel tracks, a carriage movably mounted on a pair of spaced and elongated parallel shafts, each shaft terminating in a pair of spaced wheels which precisely roll in said tracks, a grinding wheel mounted on a third shaft is journalled eccentrically within a fourth shaft, all four shafts being parallel to each other, a power means mounted on said carriage for driving said third shaft, and an eccentric control for selectively rotating said fourth shaft to raise or lower the grinding surface of said grinding wheel, said eccentric control comprises a stud on said forth shaft and a length adjustable arm rotatably mounted on said carriage and rotatably connected to said stud.

2. The grinder of claim 1 wherein the spaced parallel tracks are each V-shaped and the wheels are correspondingly V-shaped to precisely roll in said tracks.

3. The grinder of claim 1 wherein the length of said arm is adjustable by screw thread means.

4. The grinder of claim 1 further comprising sleeve means for slideably mounting said carriage on said pair of said shafts.

5. The grinder of claim 1 wherein said eccentric control arm comprises a hollow shaft having a longitudinal slot in the wall of said shaft for a portion of its length, a fixed pin to which said shaft is slideably and pivotably connected by means of said slot, two springs biased against said pin and positioned internally in said shaft exerting axial force on said shaft, a screw thread adjustment in one end of said shaft in contact with the spring of said one end of said shaft, and the other end of said hollow shaft being the portion of said arm rotatably attached to said fourth shaft.

6. In a grinding machine a mechanism for raising and lowering a grinding wheel by eccentric rotation of the drive shaft of said grinding wheel by an eccentric means surrounding the drive shaft, the eccentric means being controlled by a device comprising a hollow shaft having a longitudinal slot in the wall of said shaft for a portion of its length, a fixed pin to which said shaft is slideably and pivotably connected by means of said slot, two springs biased against said pin and positioned internally in said shaft exerting axial force on said shaft, a screw thread adjustment in one end of said shaft in contact with the spring in said one end of said shaft, and the other end of said hollow shaft being rotatably attached to the eccentric means in which said drive shaft is mounted.

7. The grinder of claim 2 wherein each said track includes an elongated undercut for collecting abrasive dust which fall onto said track during use of said grinding wheel and movement of said V-shaped wheels along said tracks.

* * * * *